US005934717A

United States Patent [19]

Wirths et al.

[11] Patent Number: 5,934,717

[45] Date of Patent: Aug. 10, 1999

[54] MOTOR VEHICLE LID OR DOOR LOCK

[75] Inventors: Rainer Wirths; Marc Georgenthum, both of Wuppertal, Germany

[73] Assignee: Robert Bosch GmbH, Stuttgart, Germany

[21] Appl. No.: 08/833,958

[22] Filed: Apr. 11, 1997

[30] Foreign Application Priority Data

Apr. 11, 1996 [DE] Germany ..... 196 14 122

[51] Int. Cl.[6] ..... E05C 3/06

[52] U.S. Cl. ..... 292/201; 292/216; 292/DIG. 43

[58] Field of Search ..... 292/201, 216, 292/DIG. 23, DIG. 43, 341.16, DIG. 27

[56] References Cited

U.S. PATENT DOCUMENTS 5,020,838 6/1991 Fukumoto ..... 292/216
5,118,146 6/1992 Watanuki ..... 292/DIG. 43

FOREIGN PATENT DOCUMENTS 32 42 527 5/1984 Germany .
38 01 581 10/1988 Germany .

*Primary Examiner*—Darnell M. Boucher

*Attorney, Agent, or Firm*—Sixbey, Friedman, Leedom & Ferguson; David S. Safran

[57] ABSTRACT

A motor vehicle lock, especially a tailgate lock in which the opening motion can be triggered by a pure switching measure and then proceeds automatically without fault, preferably without using microswitches. This motor vehicle lock has a lock latch (1) with a front catch (3) and a main catch (4), a detent pawl (6, 6') with a catch projection (9) and an actuating surface (10), as well as a drive element (11) and a driver (12, 12') located thereon. The driver (12, 12') strikes an actuating surface (10) by turning in one direction and lifts the catch projection (9) of the detent pawl (6) out of the main catch (4) and turns off the drive after the lifting process, with the detent pawl (6, 6') remaining in the lifted position. Importantly, the catch projection (9) of the detent pawl (6) overlaps the lock latch (1) on the front catch (3) when the detent pawl (6, 6') is lifted out of main catch (4), and by shifting lock latch (1) into the open position, the detent pawl (6) is moved further into an overtravel position. In the overtravel position, the driver (12) is then released by the detent pawl (6) and is moved into its initial position or another position which no longer influences detent pawl (6). Essentially, a mechanical scanning of the open position of the lock latch is created which makes use of a microswitch superfluous.

13 Claims, 14 Drawing Sheets

MOTOR VEHICLE LID OR DOOR LOCK

BACKGROUND OF THE INVENTION

1. Field of the Invention

The invention relates to a motor vehicle lid or door lock, especially to a tailgate lock. In particular, the invention is directed to such a lock which has a front catch, a main catch, and a lock latch which can be moved from and open position into a front catch position and into a main catch position and vice versa, with a detent pawl which keeps the lock latch in the front catch position and main catch position and a corresponding catch projection and actuating surface, as well as with a motorized, preferably electric motor drive with drive element having a driver located thereon. Still further, to such a lock in which, by turning the drive element in one direction, i.e., a lifting and rotating direction, the driver strikes the actuating surface and lifts the catch projection of the detent pawl out of the main catch, and in which the drive is turned off after the lifting process with the detent pawl remaining in the lifted position 2. Description of Related Art The known motor vehicle deck lock or door lock on which the invention is based (German Patent Application A-32 42 527) is described in the prior art as a motor vehicle side door lock. This lock has an extensive motorized drive, specifically an electric motor. Both the lock latch and the detent pawl are driven by an electric motor, the lock latch being a closing aid, and the detent pawl being an electric motor trigger. Prior art shows specifically only a single electric drive motor which can be coupled by drive engineering both to the lock latch (in one direction of rotation) and also to the detent pawl (in the other direction of rotation) via a step-down gear which works in two directions. Only the electric motor drive in its relation to the detent pawl is of interest for the teaching of the present invention.

In the aforementioned prior art, the lock latch is provided with a double detent which is conventional for side door locks, specifically as a fork latch made with a front catch on the forward fork latch leg and a main catch on the after fork latch leg. The lock latch is held in the front catch position and in the main catch position by a tension-loaded detent pawl with a corresponding catch projection. The detent pawl is supported on a bearing axis and has two arms, the second arm of the detent pawl pointing away from the catch projection having an actuating surface. The electric motor drive has a drive element made as a pinion, to which a driver in the form of a cam disk is attached, with a stop edge which forms an eccentric driver. This drive element can only rotate in one direction, and therefore, is not set back, but always continues to return to its initial position in the direction of rotation. By turning the drive element in the lifting and rotating direction, the driver strikes the actuating surface of the detent pawl and lifts the catch projection of the detent pawl out of the main catch on the rotary latch.

In the prior art explained above, starting of the electric motor drive is triggered by actuating a handle, for example, an outside door handle; this actuation switches a microswitch. After successfully lifting the detent pawl out of the main catch by means of the driver, the driver stops on another microswitch and first shuts off the electric motor drive again. In doing so, the detent pawl remains in the lifted position. In this way, the rotary latch can reach its opening position unhindered by the detent pawl, and therefore, the detent pawl does not descend into the front catch of the rotary latch. This state lasts until the handle, for example, the outside door handle, is released. Releasing the handle switches the first switch again, which thus turns on the electric motor drive again. The cam disk which forms the driver continues to turn into its initial position in which the detent pawl drops back again or rests on the front fork latch leg under force of the reset spring. When the vehicle door or tailgate is closed the detent pawl can, therefore, drop again into the front catch on the lock latch under the spring force.

The aforementioned explanation illustrates that the proper function of holding the detent pawl open presupposes positive actuation of the handle by a person. When a person releases the handle before the rotary latch has reached the open position, it can happen that the detent pawl drops into the front catch of the rotary latch although the door or lid has not yet completely opened. This is not very problematical in this type of drive engineering since further pulling on the handle allows the trigger cycle for the detent pawl to be repeated. The entire control system, however, assumes the use of different microswitches; this is problematical with regard to operating reliability.

Motor vehicle locks are known in which the opening motion can be triggered solely by a switching measure, in which, therefore, positive actuation of a handle, such as the outside door handle, and holding of the handle are not a prerequisite for the above explained operation. In these locks there is a so-called "snow load lever" (German Patent C-38 01 581). A "snow load lever" is an additional lever which, when the lifting position of the detent pawl is reached, drops relative to the detent pawl such that the detent pawl is held in the lifted position until the rotary latch has reached its open position. In this position the "snow load lever" is swivelled free of the detent pawl so that it is again operable with respect to the front catch of the rotary latch. This mechanical technique is a proven and feasible one, since it solves the problem of a lid or door which does not open by itself, for example, when loaded by snow, when the reset force of the seal is not sufficient, or when the seal is frozen solid (otherwise, either two persons would have to switch on the one hand and open on the other, or the electric motor drive would run continually back and forth). The mechanical solution with the additional "snow load lever" is, however, a problem in terms of cost from the current standpoint; any additional lever with a bearing spike and pretensioning spring in a motor vehicle lock represents a cost factor, but also a risk factor (sticking, breaking). The solution known from practice with the mechanical "snow load lever" is therefore not optimum either.

In a motor vehicle lock in which lifting of the detent pawl is caused by purely electrical means, especially via a solenoid, a "snow load function" can be accomplished by purely control engineering means, if the corresponding switching functions are provided. Then, the rotary motion of the rotary latch must be scanned until the open position is reached. This in turn requires microswitches.

Furthermore, a motor vehicle lock is known in which the lock latch has only one main catch, and therefore, there is no front catch (German Patent C-39 32 268). Here, there is an electric motor drive which is not self-locking, but is reset into its initial position by means of spring force when the power supply current is turned off. In this motor vehicle lid lock, there is an elastic stop for the detent pawl and its lifted position. As soon as the detent pawl has reached the elastic stop, and thus its lifted position, the electric motor drive is turned off. The drive element which is made as a disk and which represents the worm wheel of an electric motor worm drive is turned backwards around its axis of rotation by a pretensioned reset spring, and in this way, is returned to its initial position. The driver thus returns by the reverse running direction into its initial position on the same path on which it has approached the actuating surface of the detent pawl on the way there. Here it is provided that the lock latch which is in the open position keeps the detent pawl in the lifted position. When the lid is then closed, the lock latch easily releases the detent pawl and the pawl can return to the drop position under the action of a spring. This concept cannot easily be applied to motor vehicle locks with a front catch and a main catch.

SUMMARY OF THE INVENTION

Therefore, it is a principle object of the present invention to configure and develop the known, initially explained motor vehicle lock such that the opening motion can be triggered by a pure switching measure and can then proceed automatically without fault, preferably without using microswitches.

This object is achieved, in accordance with a preferred embodiments of the invention, by providing, in a motor vehicle lid lock or door lock of the initially mentioned type, an overlap between the catch projection of the detent pawl and lock latch on the front catch when the detent pawl is lifted out of the main catch. Furthermore, by shifting the lock latch into the open position, the detent pawl can be moved further in the lift direction into an overtravel position and that, in the overtravel position driver, is released by the detent pawl and is moved into its initial position or another position which no longer influences the detent pawl.

It has been recognized according to the invention that, on the one hand, continuous actuation of a handle, and on the other hand, the use of an additional "snow load lever" can be abandoned by departing from the concept which has long been used in motor vehicle locks that the lifted position of the detent pawl with respect to the main catch also results in passage of the rotary latch under the detent pawl with the main catch. According to the invention, the detent pawl raised out of the main catch has an overlap with the lock latch on the front catch. Only by actively moving the lid or door above and beyond the front catch is the rotary latch moved into its open position. Another switching function or movement of the lock parts is, therefore, triggered only after reliable, complete opening of the rotary latch. This mechanical measure, therefore, makes the use of a microswitch for scanning the open position of the lock latch superfluous. Likewise, it is unnecessary to actively actuate a handle or the like over a longer time; therefore, triggering can take place using purely switching engineering means.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

A first embodiment of the invention is explained first using FIGS. 1 through 7. While the example of a motor vehicle door lock is used to explain the invention, it should be understood that the invention is not limited thereto, and is usable for locks for vehicle lids, tailgates and other vehicle body closures.

Figure 1:
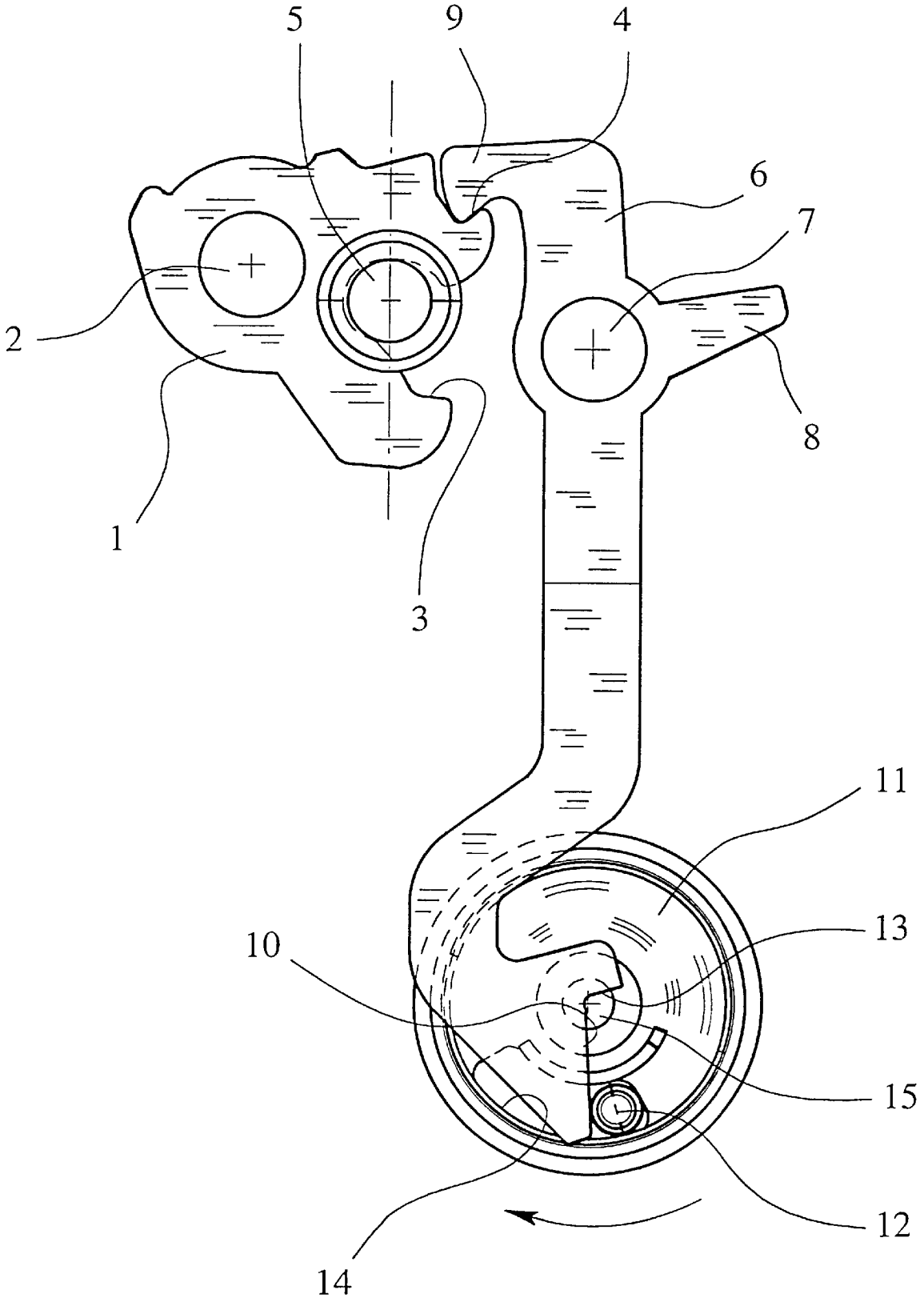
FIG. 1 shows a first embodiment of a motor vehicle lid or door lock according to the invention in a closed position.

In FIG. 1, the parts which are not critical to the invention have been omitted, all such omitted parts being known to those skilled in the art, such as from the initially-mentioned prior art disclosure. First of all a lock latch 1 is shown which can be moved from an open position into a front catch position and into a main catch position and vice versa. As shown, the lock latch 1 is made as a rotary latch that is pivotally mounted on a bearing axis 2 and which is provided with a front catch 3 and main catch 4. In this embodiment, a closing hinge 5 is accommodated between the fork legs of lock latch 1 which is in the closed position.

Furthermore, there is detent pawl 6 which holds lock latch 1 in the front catch position (FIG. 3) and main catch position (FIG. 7); it is supported on a bearing axis 7, is made as a tensioned detent and with two arms, one at each end. An additional, third arm 8 is used for engagement of an emergency actuation lever (not shown) when the electricity fails.

On the first arm, the detent pawl 6 has a catch projection 9 with which it holds the lock latch 1 engaged to main catch 4 in the closed position (FIG. 1). In addition, on the second arm, the detent pawl 6 has an actuating surface 10.

There is a motorized drive, preferably an electric motor drive, in the embodiment shown, having a drive element 11. In the prior art, the electric motor drive has been made as an electric motor worm drive with a drive spindle, worm wheel and eccentrically arranged driving lug or driving arc on the worm wheel. This embodiment is based on the use of such a drive arrangement but, in principle, the teaching of the invention can be accomplished with a host of other electric motor or other motorized drives.

Figure 2:
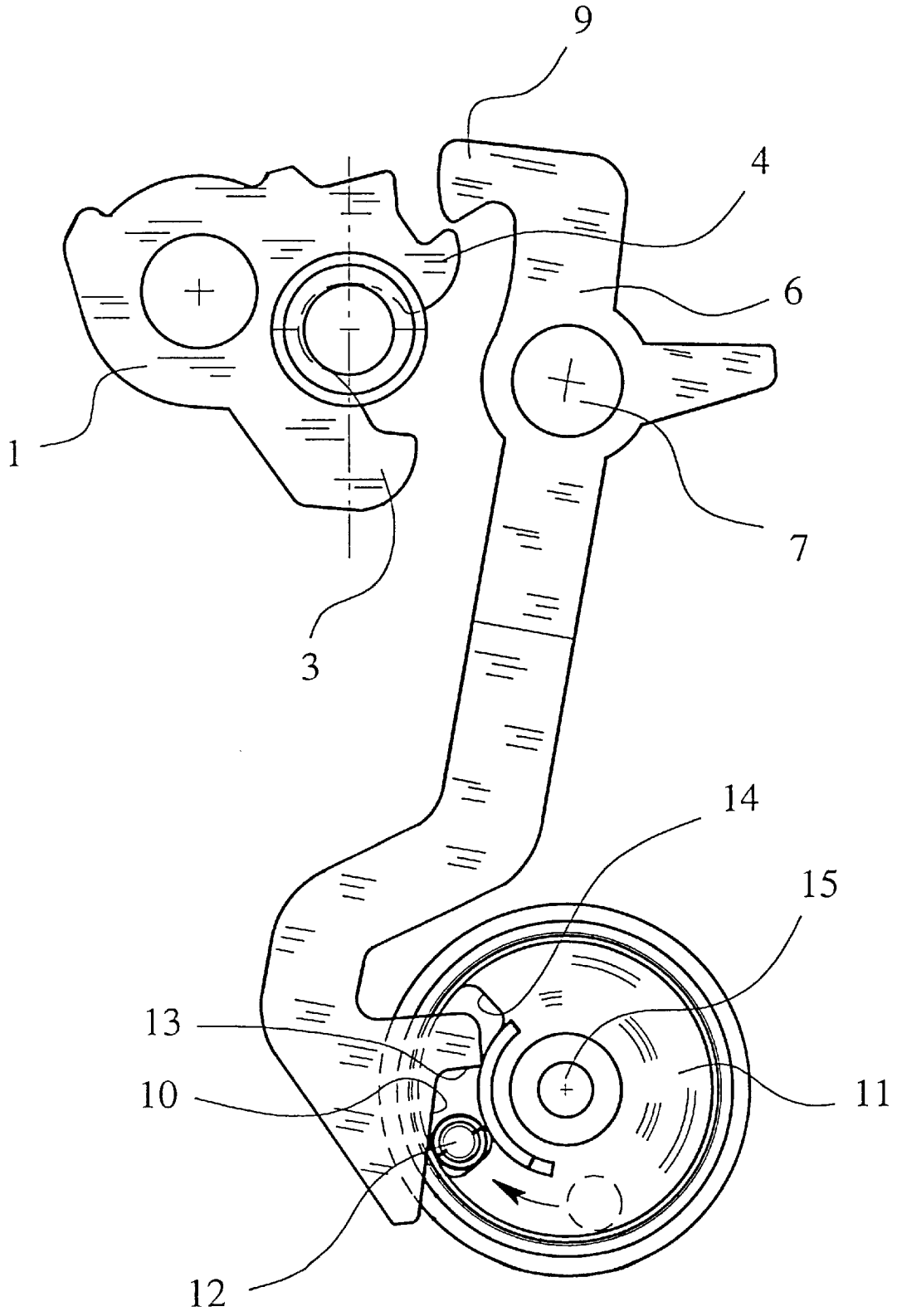
FIG. 2 shows the lock of FIG. 1 in a lifted detent position.

In any case, drive element 11 has a driver 12 located thereon, which strikes actuating surface 10 due to rotation of drive element 11 in one direction (i.e., the lifting-turning direction represented by the arcuate arrow in FIG. 1) and causes the catch projection 9 of detent pawl 6 to be lifted out of main catch 4 as a result (FIG. 2). After this lifting process, the drive is turned off and detent pawl 6 is held in the lifted position.

Figure 6:
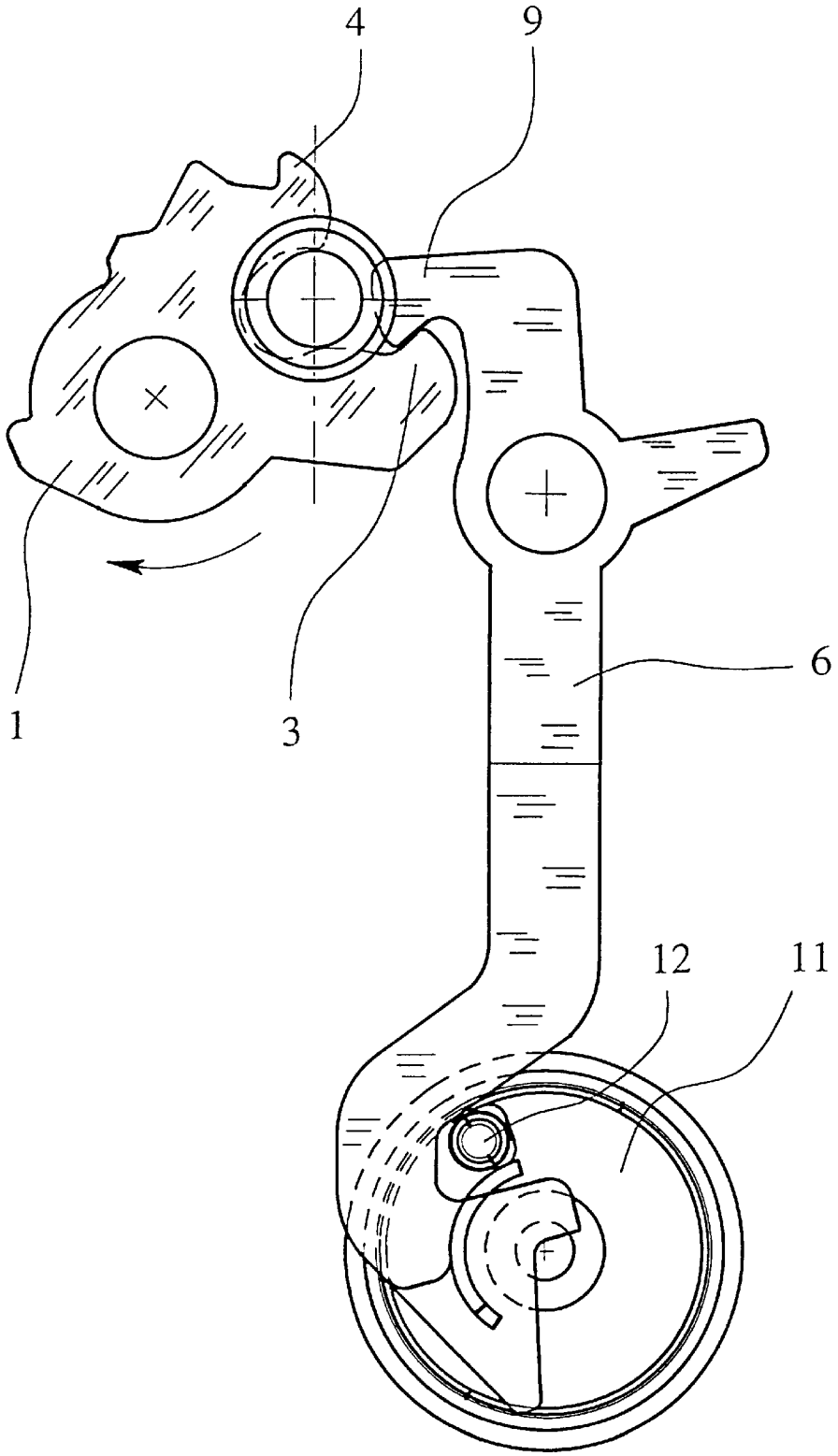
FIG. 6 shows the lock of FIG. 1 in a front catch position.

FIG. 1 shows the closed position of the motor vehicle door lock with the drive starting, FIG. 2 the position in which driver 12 pivots the detent pawl 6 around bearing axis 7 and lifts it out of main catch 4, and FIG. 6 shows the end of this phase in which lock latch 1 has left the main catch position and has reached the front catch position.

Figure 3:
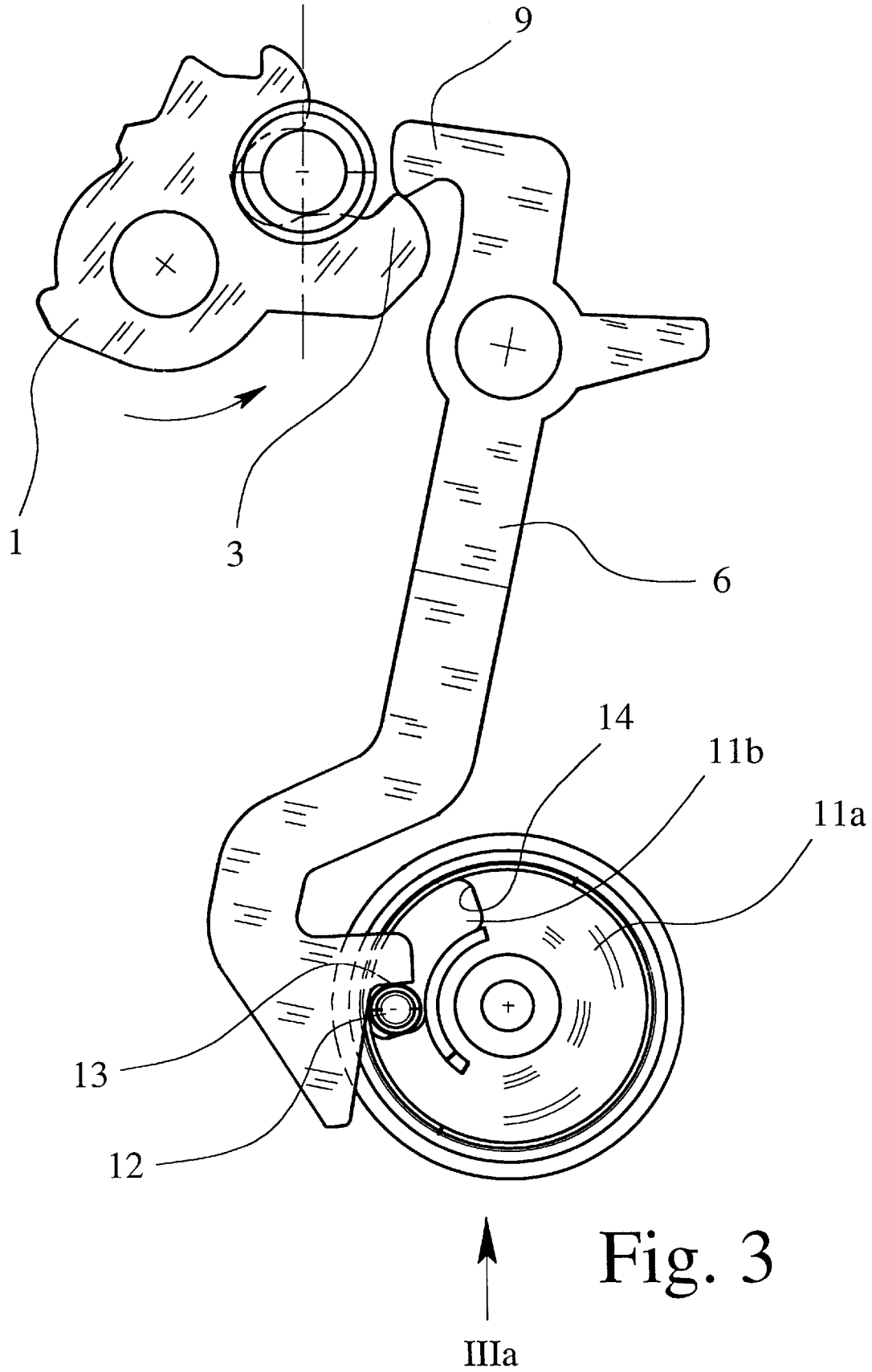
FIG. 3 shows the lock of FIG. 1 in an overlap position.
Figure 4:
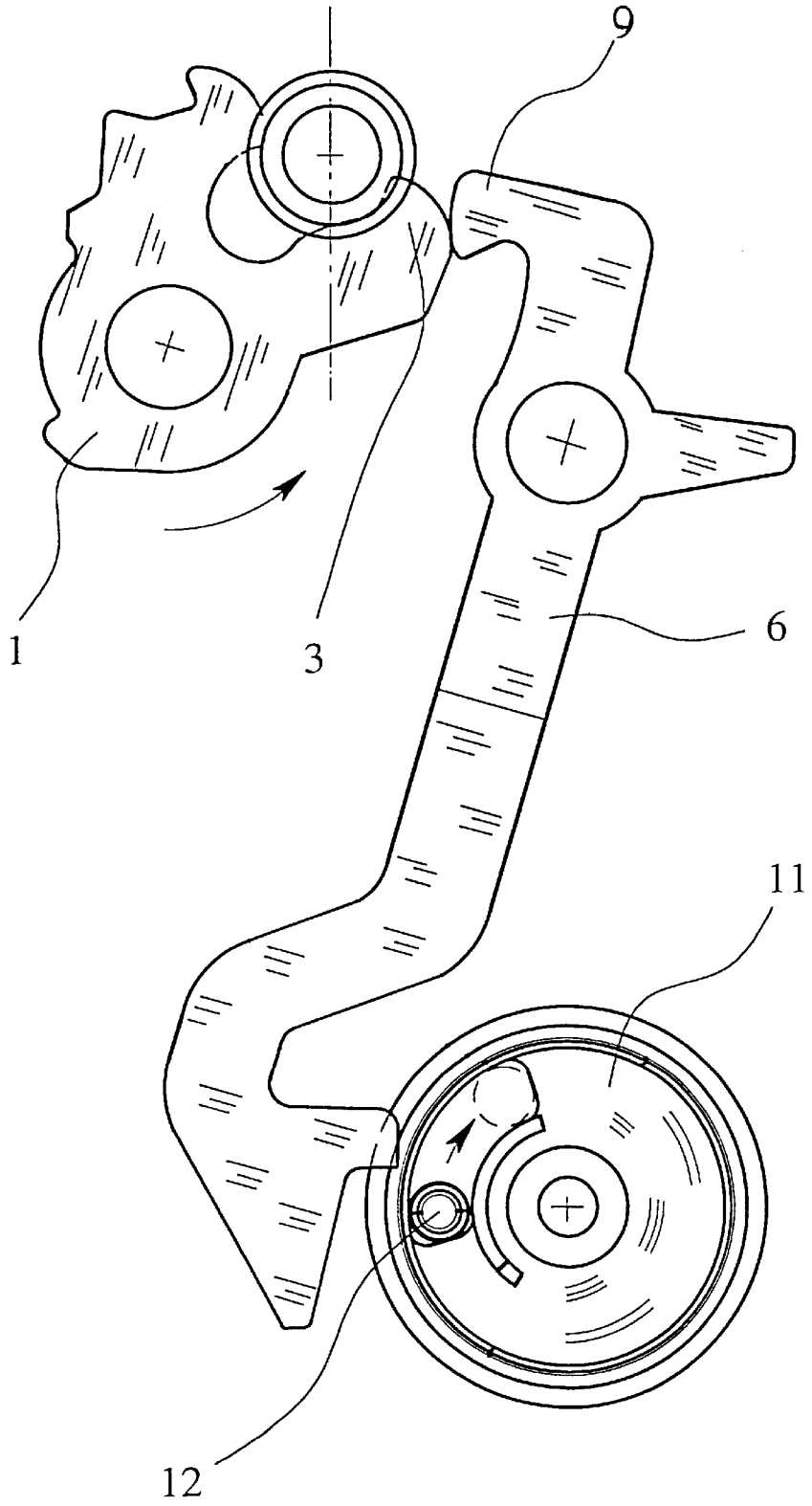
FIG. 4 shows the lock of FIG. 1 in an overtravel position.
Figure 5:
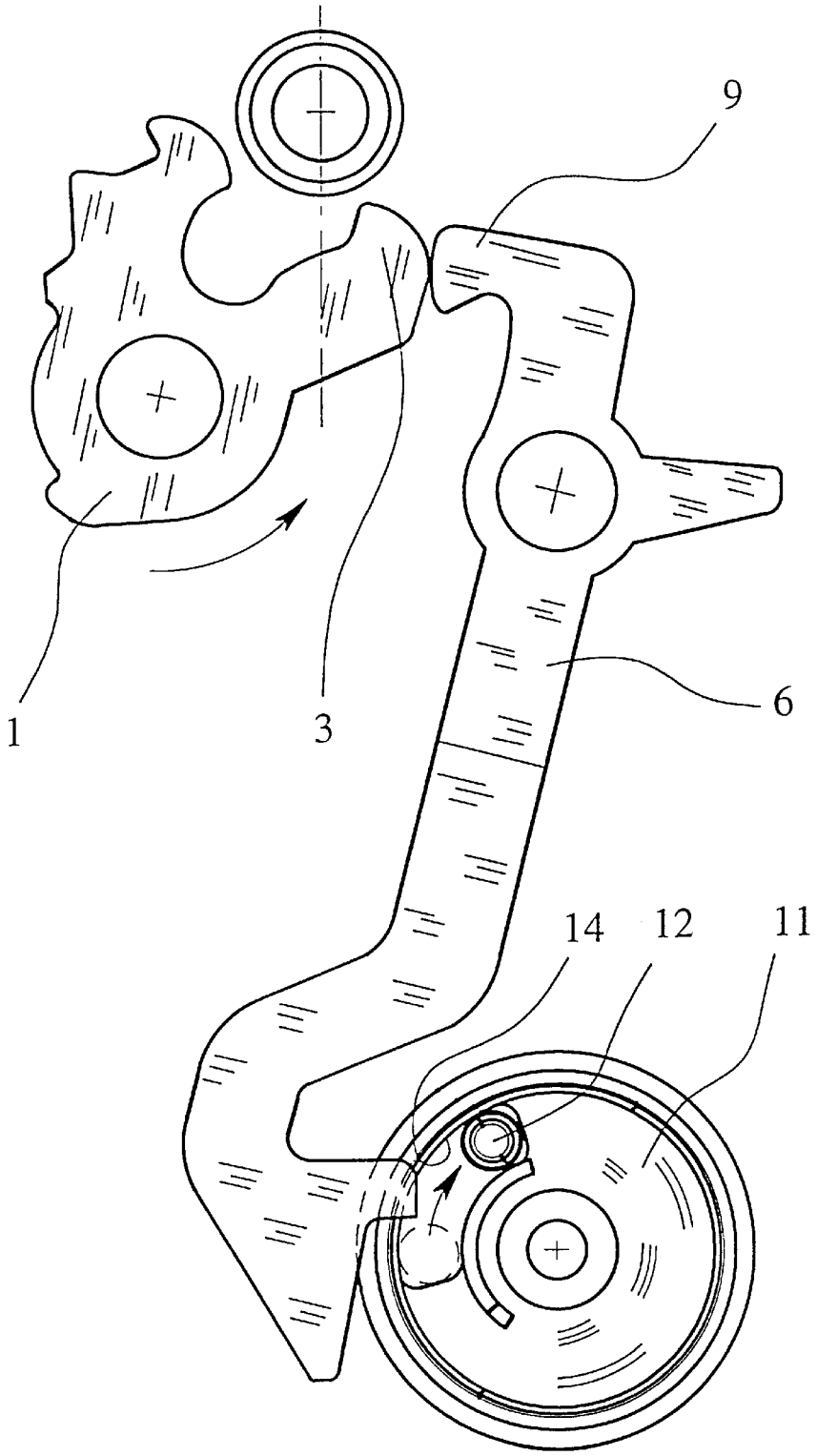
FIG. 5 shows the lock of FIG. 1 in an open position.

The passage from FIGS. 3 to 4 illustrates the invention. From these views it can be seen that the catch projection 9 of detent pawl 6 overlaps the lock latch 1 on front catch 3 when the detent pawl 6 is lifted out of main catch 4. This means that lock latch 1, which in the illustrated embodiment is made as a rotary latch, cannot easily swing past the detent pawl 6 when it is in the lifted position with respect to main catch 4 because the leg of pawl 6 is on the front catch 3. This overlap represents, to some extent, a mechanical "scanning" of the complete open position of the lock latch 1. Only by shifting lock latch 1 into the complete open position can detent pawl 6 be moved further in the lift direction into an overtravel position. This overtravel position is shown in FIG. 4. In the overtravel position, the driver 12 is released from detent pawl 6. From here, the driver 12 can be moved into its initial position, or another position in which, in any case, it no longer affects detent pawl 6. FIG. 5 shows this position. It is furthermore clear that here lock latch 1 which is in the open position, as is common, keeps detent pawl 6 in the lifted position or roughly on the other side of the lifted position as far as the overtravel position.

It is also provided, in this embodiment, that the drive element 11 is made as a disk and driver 12 as an eccentric driving lug attached to the disk.

In the motor vehicle lid lock or door lock according to the invention, the microswitch control known from the prior art (German Application A-32 42 527) can be retained. But, it is more feasible if microswitches can be abandoned. For this reason, in the embodiment shown, it is provided that there is driver stop surface 13 on detent pawl 6 which follows the actuating surface 10 in the direction in which driver 12 rotates and which lies in the path of movement of driver 12 when detent pawl 6 is lifted out of the main catch 4. Driver stop surface 13 stops the driver 12 in the front catch position of FIG. 3, but is outside of the path of movement of the driver 12 when detent pawl 6 is in the overtravel position of FIG. 4. The drive is turned off (block mode) by driver 12 striking stop surface 13.

FIG. 3 shows driver 12 (which in this case is made as a lug) striking the driver stop surface 13; this then causes the electric motor drive to be turned off. With this blocking operation, the power consumption of the electric drive motor is monitored and shutoff, being triggered when the power rises after a certain delay time.

As an alternative, in conjunction with the other embodiment of FIGS. 8 through 12, it is shown that there is driver stop surface 13' on driver 12' which strikes detent pawl 6' when the pawl 6' is lifted out of main catch 4 and stops driver 12', but when detent pawl 6' is in the overtravel position runs past on it. When the driver stop surface 13' strikes the detent pawl 6', the drive is turned off (block mode).

The first embodiment according to FIGS. 1 through 7 is made such that drive element 11 turns in only one direction and the drive itself is made self-locking throughout.

In particular, it is provided in this embodiment that driver 12 (which is made as a driving lug) can be moved relative to drive element 11 in relative terms over an arc that is limited to a small angle, here an angle of roughly 70°, that drive element 11 has clearance cut 14 which allows this relative motion of driver 12, and that driver 12 is pretensioned by a spring (not shown) into the end position which leads in the direction of rotation of drive element 11, i.e., that shown in FIG. 5.

Figure 3A:
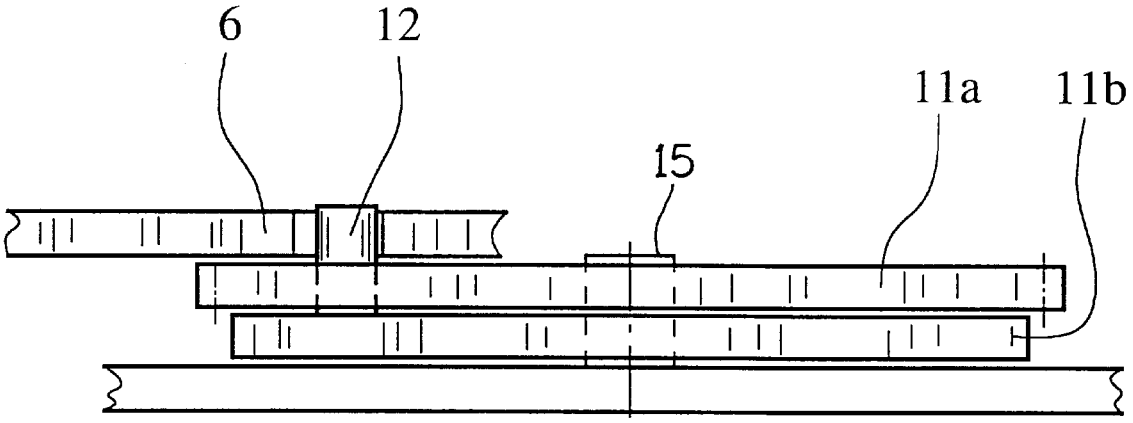
FIG. 3*a* is a partial view of the arrangement of the elements as seen in the direction of arrow IIIa in FIG. 3.

Furthermore, as shown in FIGS. 3 & 3*a,* the drive element 11 is formed of two partial elements 11*a,* 11*b* which are located in succession in the direction of its bearing axis 15. One partial element, specifically the partial element 11*a* shown at the top in the drawing, is securely coupled to the electric motor drive and is provided with the above-noted clearance cut 14, while the partial element 11*b* which is underneath in these figures carries the driver 12. The above-mentioned, unillustrated spring acts between these two partial elements 11*a,* 11*b;* a coil spring having its coils around bearing axis 15 and ends bent into legs, each of which engage a respective one of the partial elements 11*a,* 11*b* can be used for this purpose.

Proceeding from FIG. 1, it can be seen that, in the opening process, first driver 12 on second partial element 11*b* comes to rest on actuating surface 10 of detent pawl 6. Further turning of drive element 11 leads to first partial element 11*a* continuing to turn, second partial element 11*b* with driver 12 remaining stationary for the time being, until the spring is tensioned and the end of clearance cut 14 is reached. This position is shown in FIG. 1.

At this point, the opening motion of detent pawl 6 (FIG. 2) begins. Driver 12 continues to move detent pawl 6 so that catch projection 9 of detent pawl 6 releases main catch 4 of lock latch 1 (FIG. 3) and closing hinge 5 is shifted, for example, under the action of the reset force of the lid seal, in the opening direction, and in doing so, somewhat entrains lock latch 1. Driver 12 continues to move until it reaches the driver stop surface 13, and after the aforementioned delay, time turns off the electric motor of the drive (block mode).

If, at this point, the lid or door is pulled, therefore actively opened, the overlap of lock latch 1 on front catch 3 with catch projection 9 on detent pawl 6 mechanically moves the detent pawl in the manner of a key gear into the overtravel position (FIG. 4). As a result, the driver stop surface 13 is swung out of the path of motion of driver 12, which can now be pushed forward (in the direction in which drive element 11 turns under the action of the tensioned spring) into the end position shown in FIG. 5. FIG. 4 shows driver 12 just after this release has been completed and before this spring-loaded reset motion is executed (jointly with second partial element 11*b*), and FIG. 5 shows the point where driver 12 has reached the leading end position in clearance cut 14.

In this case, the drive motor has not been turned on at all, and this reset motion takes place exclusively by spring force. At the same time, it is recognized that detent pawl 6 has returned again slightly from the overtravel position, but has not yet reached the normal main catch lift position; specifically, the detent pawl 6 is held in a lateral lift position by the lock latch 1 which is in the open position.

Figure 7:
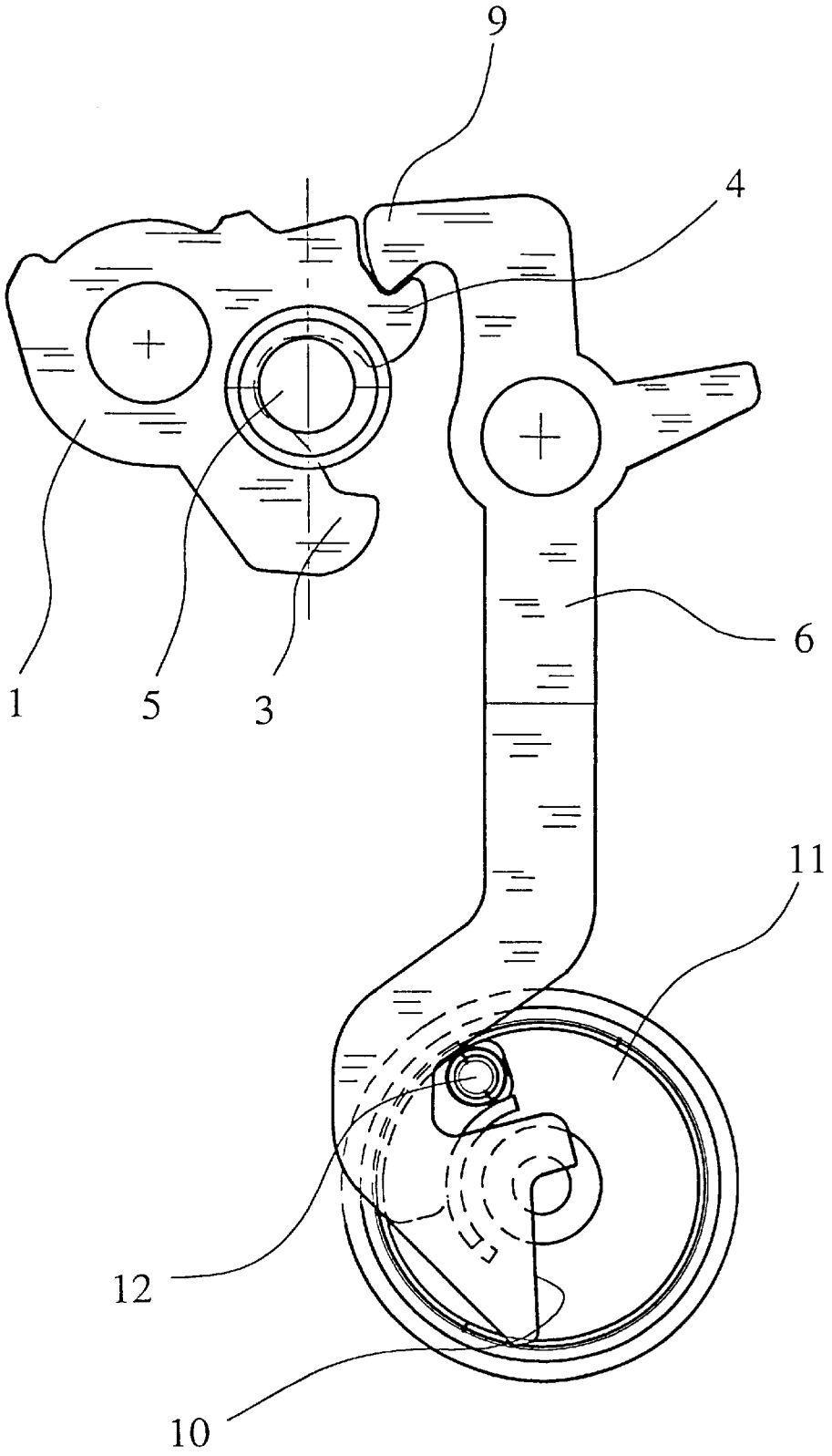
FIG. 7 shows the lock of FIG. 1 in a main catch position.
Figure 8:
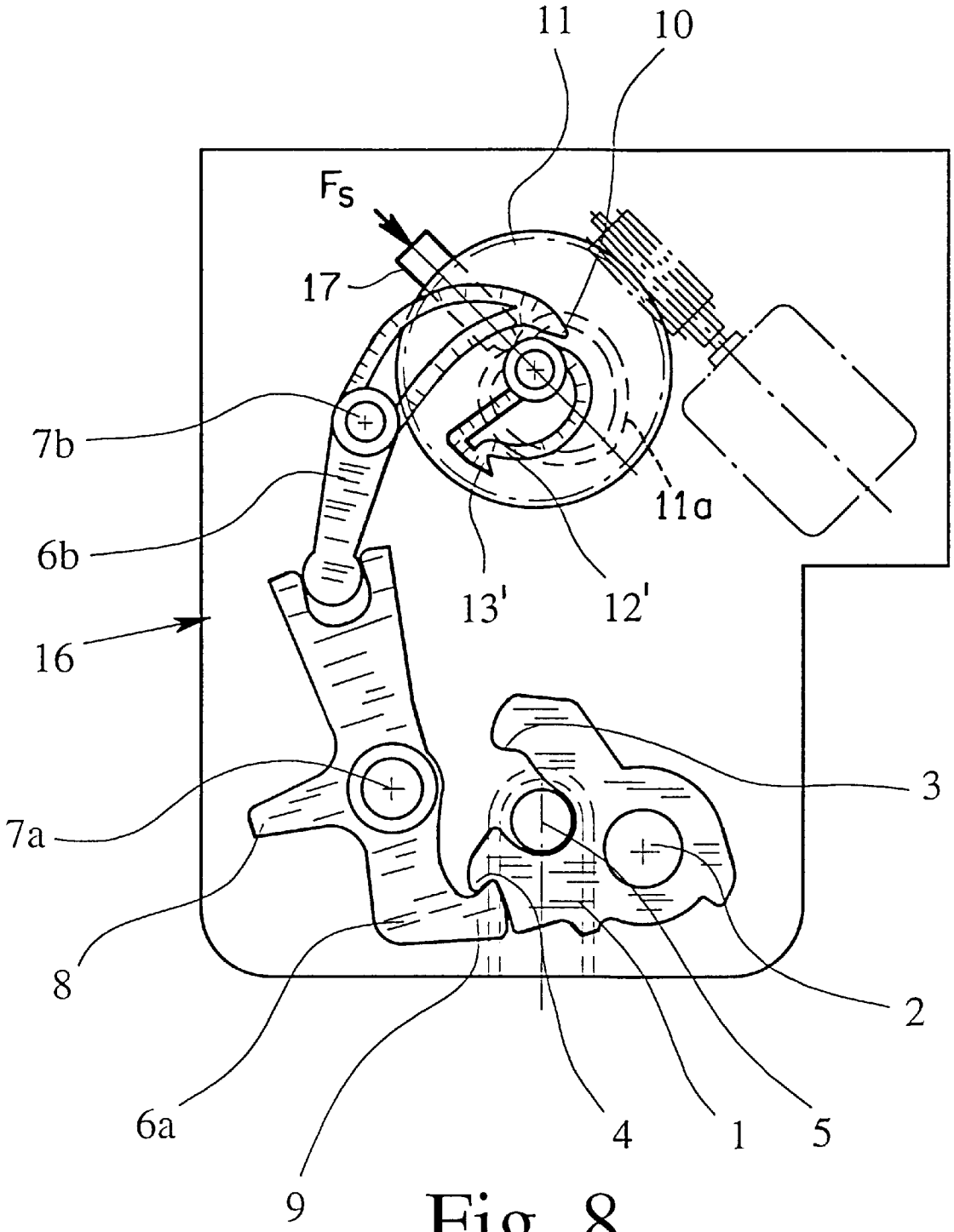
FIG. 8 shows another preferred embodiment of the motor vehicle lid or door lock according to the invention in a closed position.
Figure 9:
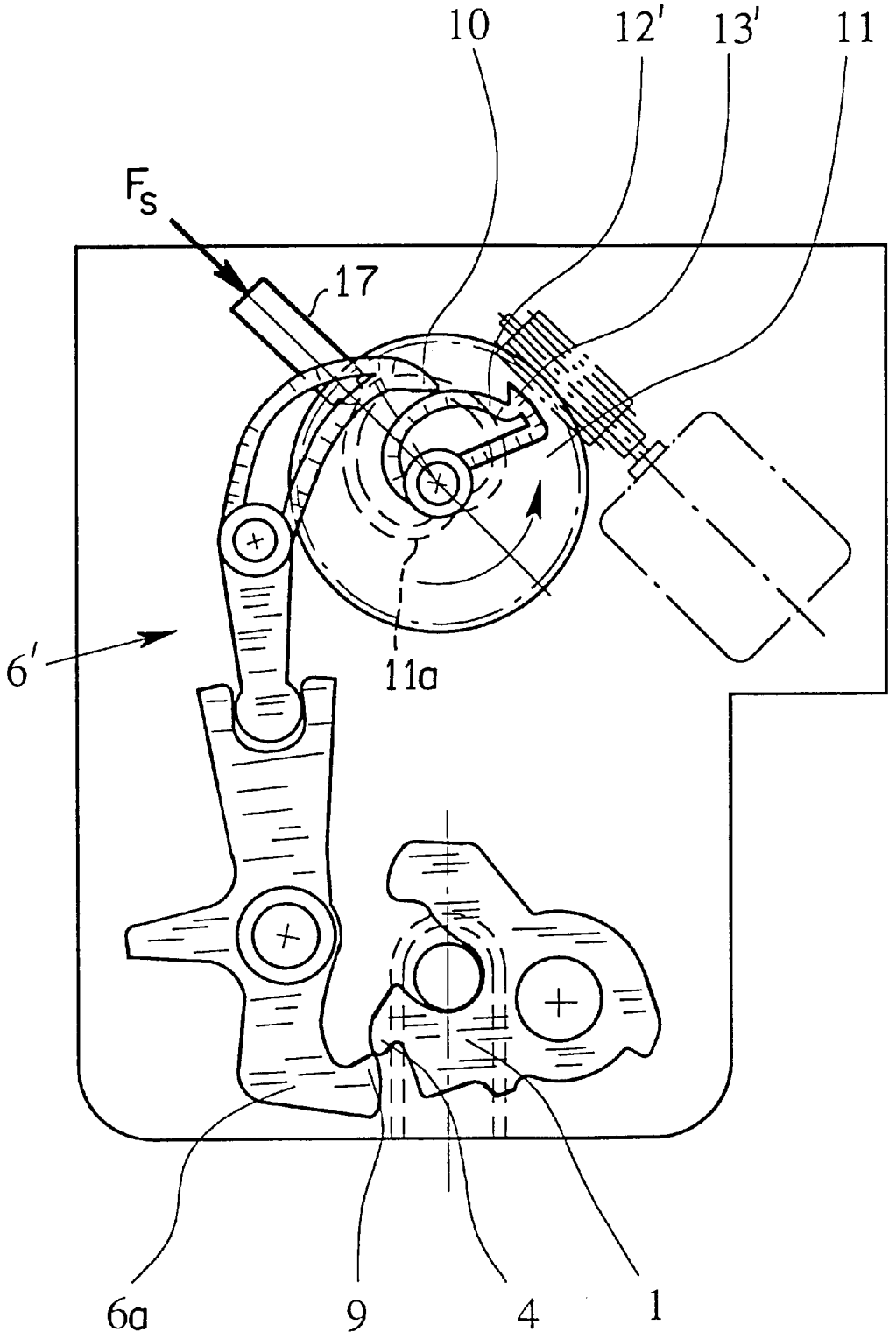
FIG. 9 shows the lock of FIG. 8 in a lifted detent position.
Figure 10:
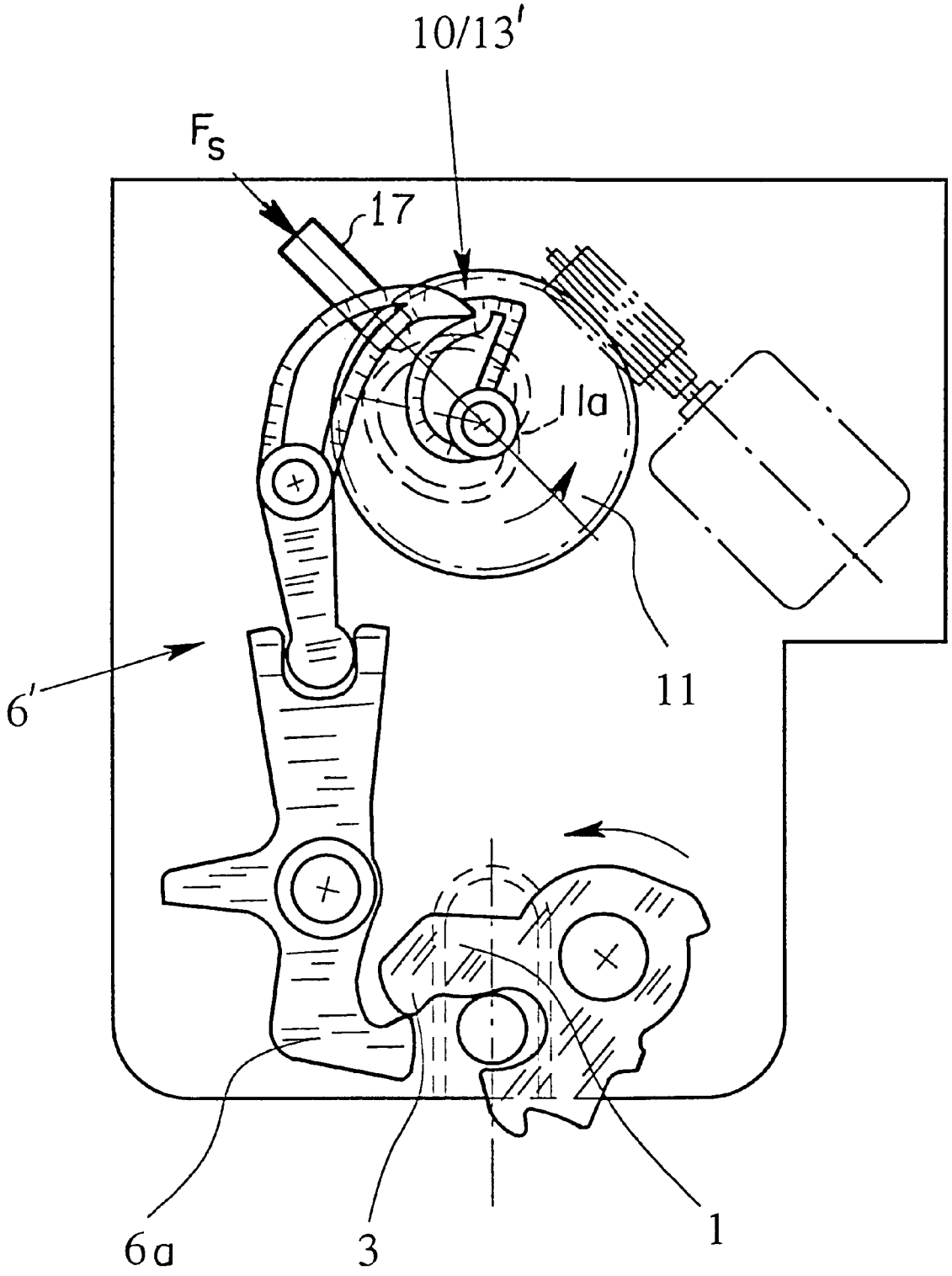
FIG. 10 shows the lock of FIG. 8 in an overlap position.
Figure 11:
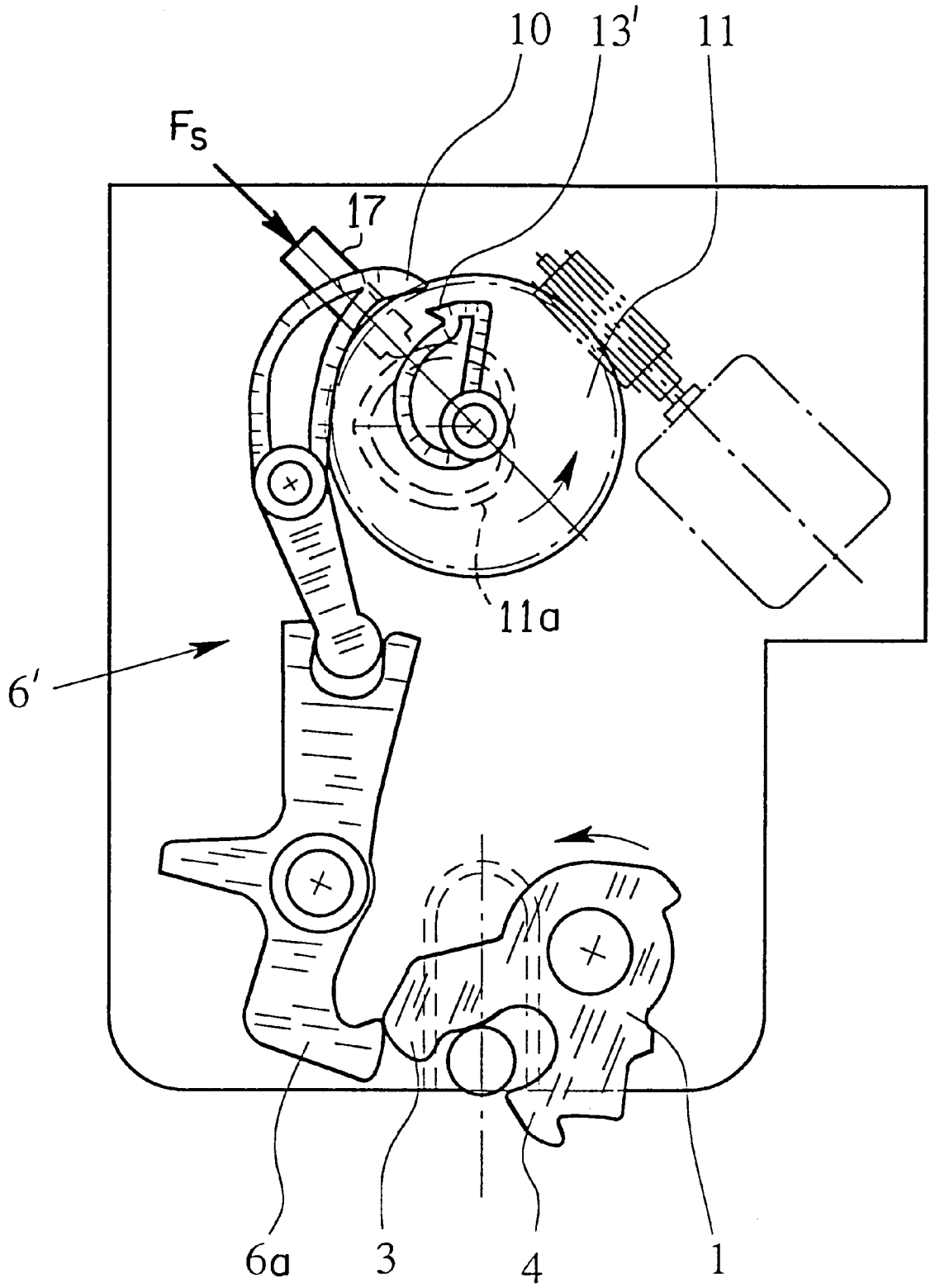
FIG. 11 shows the lock of FIG. 8 in an overtravel position.
Figure 12:
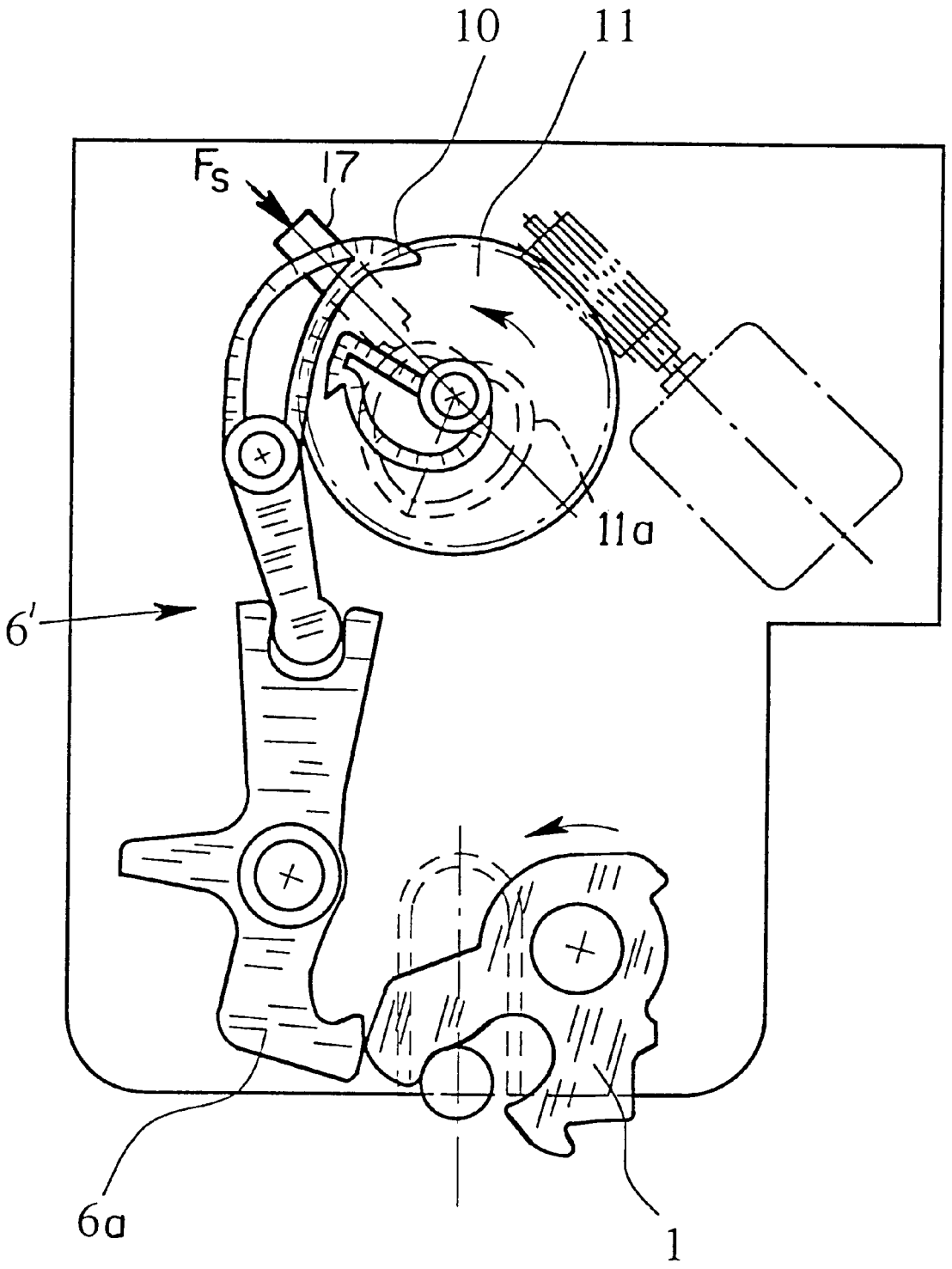
FIG. 12 shows the lock of FIG. 8 in an open position.
Figure 13:
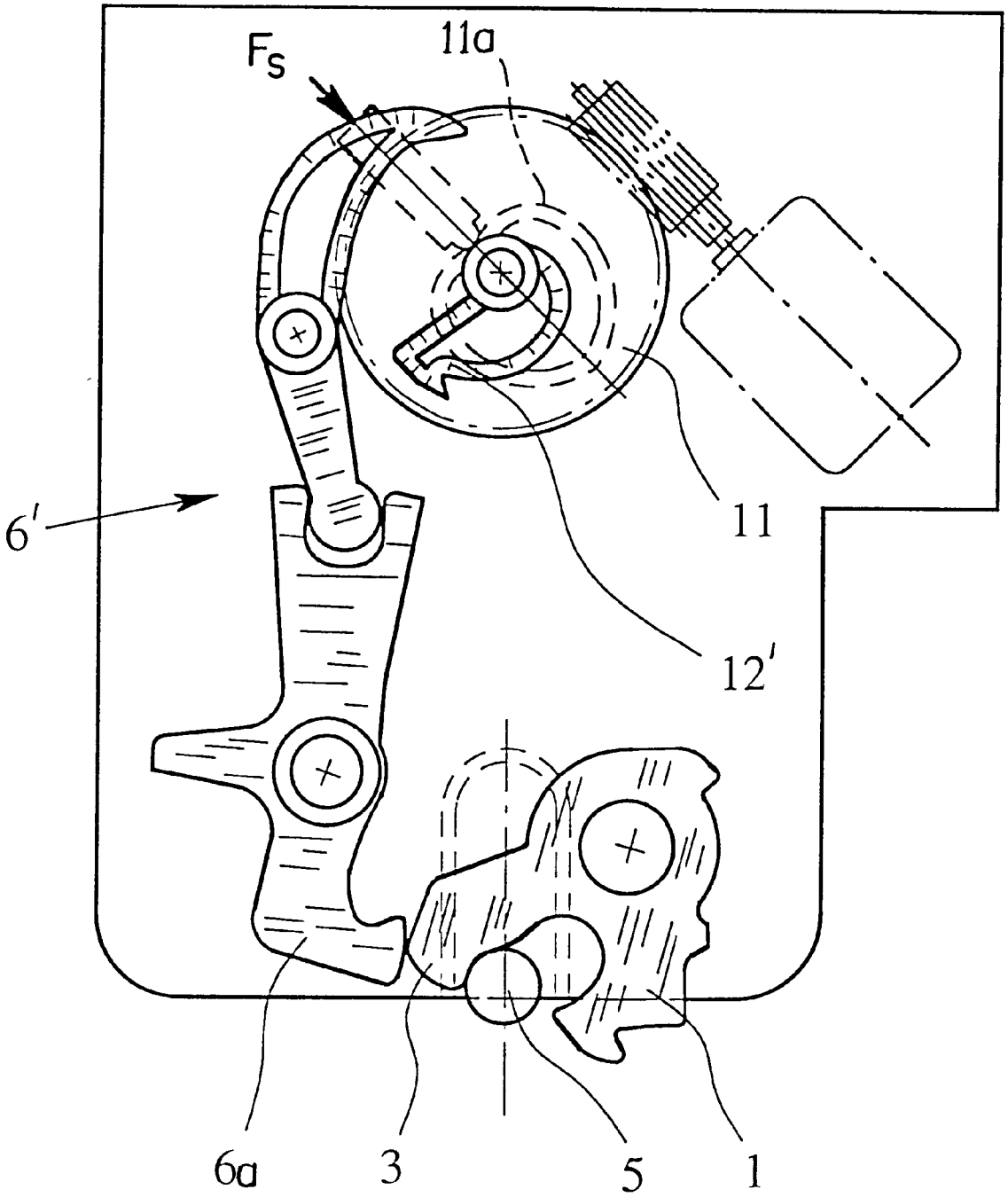
FIG. 13 shows the lock of FIG. 8 in the open position, but with the drive element having returned to the starting position of FIG. 8.

FIG. 6 shows the front catch position being reached as the motor vehicle lid or door is re-closed. Descent of detent pawl 6 with catch projection 9 into front catch 3 is not prevented by driver 12 since, as explained above, it has been moved by means of the springs into the end of the slot 14 which leads in the direction of rotation of drive element 11. The return motion of lock latch 1 into the main catch position (descent of catch projection 9 into main catch 4) is likewise unobstructed. FIG. 7 shows this end position, the closed position of the motor vehicle lid or door lock being reached. This position is, at the same time, the starting position for a repeated opening process; therefore, the representation in FIG. 1 would then follow the representation in FIG. 7 again.

The above explained embodiment can only be provided with a self-locking drive (i.e., one which cannot be moved by hand or other mechanical means) when the reset force of the spring between the two partial elements 11*a,* 11*b* of drive element 11 exists. If this reset function is not provided, the drive can also be one which is not self-locking (i.e., is resettable by hand or other mechanical means); but then, a corresponding microswitch technique would have to be utilized.

One embodiment of a motor vehicle lid lock or door lock according to the invention in which a drive is provided which is not self-locking but which can be reset by spring force, if necessary, is shown in FIGS. 8 through 13. Here, the drive element 11, when the drive is turned off, is pretensioned against the stop surface 13' by a spring force $F_s$ which is represented by an arrow in the upper area of FIGS. 8–13. This spring force $F_s$ acts radially in the direction of the arrow and results in a lifting and turning force acting on the drive element 11 in accordance with the location of the follower 17 on the heart-shaped control surface 11*a* (shown in phantom outline since it is located on the underside of drive element 11) and acting to hold the drive element in place in the closed position of FIG. 8 and the open position of FIG. 13. Other aspects of this embodiment have already been explained.

The embodiment in FIGS. 1 through 7 shows a conventional one-piece detent pawl 6, while the embodiment in FIGS. 8–13 shows a two-part detent pawl 6' with a bearing axis 7*a,* 7*b* for each detent part 6*a,* 6*b,* and with a loose connection 16 between the detent parts 6*a,* 6*b.*

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. Motor vehicle lock comprising:

a lock latch having front catch and a main catch, the lock latch being movable from an open position into a front catch position and into a main catch position, and from the main catch position into the front catch position and into the open position, a detent pawl having a catch projection and an actuating surface, the catch projection engaging the front catch of the lock latch in the front catch position and engaging the main catch of the lock latch in the main catch position, and a motor drive with a drive element having a driver located thereon, the drive element being rotatable by the motor drive, the drive being positioned so as to strike the actuating surface as a means for lifting the catch projection of the detent pawl out of the main catch, and stop means being provided for turning off the motor drive after the catch projection of detent pawl has been lifted out of the main catch;

wherein the catch projection of the detent pawl and the front catch of the lock latch overlap each other when the detent pawl has been lifted out of the main catch and the motor drive stopped by the stop means;

wherein, when the lock latch is displaced into the open position, the detent pawl is free to lift into an overtravel position in which the driver is released by the detent pawl and is moved into a position in which it is out of a path of movement of the detent pawl.

2. Motor vehicle lock according to claim 1, wherein drive element is a disk and the driver is a driving lug attached eccentrically to the disk.

3. Motor vehicle lock according to claim 2, wherein a driver stop surface is provided on the detent pawl, the driver stop surface being located at a far end of the actuating surface in a direction of movement of the driver, lying in a path of movement of the driver when the detent pawl is lifted out of the main catch and lying outside of the path of movement of the driver when the detent pawl is in the overtravel position; and wherein the stop means comprises the driver stop surface and driver, the drive being turned off by the driver striking the driver stop surface.

4. Motor vehicle lock according to claim 1, wherein a driver stop surface is provided on the driver, the driver stop surface configured and arranged for engaging the detent pawl when the detent pawl is lifted out of the main catch and stopping the driver, and for running past the detent pawl when the detent pawl is in the overtravel position, and wherein the stop means comprises the driver stop surface and the detent pawl, the drive being turned off by the driver stop surface striking the detent pawl.

5. Motor vehicle lock according to claim 1, wherein the drive element is rotatable in only one direction.

6. Motor vehicle lock according to claim 5, wherein the drive element has clearance cut which enables the driver to be movable relative to the drive element through an arc of approximately 70 degrees; and wherein the driver is pretensioned into an end position at a leading end of the clearance cut in the direction of rotation of drive element.

7. Motor vehicle lock according to claim 6, wherein the drive element is formed of two partial elements which are located in succession in an axial direction of a bearing axis about which the partial elements are rotatable; wherein one of the partial elements is securely coupled to the motor drive and contains the clearance cut; and wherein the other partial element carries the driver.

8. Motor vehicle lock according to claims 1, wherein the drive is of a resettable type.

9. Motor vehicle lock according to claim 8, wherein the drive element is pretensioned on the stop surface by spring force in the direction of rotation of the drive element when the motor drive is turned off.

10. Motor vehicle lock according to claim 4, wherein the detent pawl is made in two parts, each part of the detent pawl having a respective bearing axis.

11. Motor vehicle lock according to claim 1, wherein the detent pawl is made in two parts, each part of the detent pawl having a respective bearing axis.

12. Motor vehicle lock according to claim 1, wherein a driver stop surface is provided on the detent pawl, the driver stop surface being located at a far end of the actuating surface in a direction of movement of the driver, lying in a path of movement of the driver when the detent pawl is lifted out of the main catch and lying outside of the path of movement of the driver when the detent pawl is in the overtravel position; and wherein the stop means comprises the driver stop surface and driver, the drive being turned off by the driver striking the driver stop surface.

13. Motor vehicle lock according to claim 2, wherein a driver stop surface is provided on the driver, the driver stop surface configured and arranged for engaging the detent pawl when the detent pawl is lifted out of the main catch and stopping the driver, and for running past the detent pawl when the detent pawl is in the overtravel position and wherein the stop means comprises the driver stop surface and the detent pawl, the drive being turned off by the driver stop surface striking the detent pawl.

* * * * *